US007420328B2

(12) United States Patent
Kang

(10) Patent No.: US 7,420,328 B2
(45) Date of Patent: Sep. 2, 2008

(54) PLASMA DISPLAY PANEL DESIGN THAT COMPENSATES FOR DIFFERING SURFACE POTENTIAL OF COLORED FLUORESCENT MATERIAL

(75) Inventor: Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 103 days.

(21) Appl. No.: 11/143,711

(22) Filed: Jun. 3, 2005

(65) Prior Publication Data

US 2006/0006802 A1 Jan. 12, 2006

(30) Foreign Application Priority Data

Jul. 7, 2004 (KR) ..... 10-2004-0052606

(51) Int. Cl.
*H01J 17/49* (2006.01)

(52) U.S. Cl. ..... 313/582; 313/585; 313/586; 313/587

(58) Field of Classification Search ..... 313/582
See application file for complete search history.

(56) References Cited

U.S. PATENT DOCUMENTS

| | | | | |
|---|---|---|---|---|
| 5,541,618 | A | 7/1996 | Shinoda | 345/60 |
| 5,661,500 | A | 8/1997 | Shinoda et al. | 345/60 |
| 5,663,741 | A | 9/1997 | Kanazawa | 345/66 |
| 5,674,553 | A | 10/1997 | Sinoda et al. | 427/68 |
| 5,724,054 | A | 3/1998 | Shinoda | 345/60 |
| 5,786,794 | A | 7/1998 | Kishi et al. | 345/60 |
| 5,952,782 | A | 9/1999 | Nanto | 313/584 |
| RE37,444 | E | 11/2001 | Kanazawa | 345/60 |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Korean Office Action of the Korean Patent Application No. 10-2004-0052606, mailed on Feb. 23, 2006.

*Primary Examiner*—Sikha Roy
*Assistant Examiner*—Natalie K Walford
(74) *Attorney, Agent, or Firm*—Robert E. Bushnell, Esq,

(57) ABSTRACT

A plasma display panel capable of preventing faulty discharge and non-uniform discharge by applying a uniform address voltage to all subpixels. This is done by neutralizing the negative surface potential of a zinc silicate green fluorescent material using $YBO_3$:Tb as a positive surface potential material on the partition walls between the electrodes. Also, the thickness of this $YBO_3$:Tb material and a lateral spacing between a scan electrode and the positive surface potential material are carefully selected to arrive at a design resulting in no faulty pixels. Grooves can also be formed in the tops of the partition walls so that the positive surface potential material filled therein does not mix with the neighboring flourescent material.

20 Claims, 8 Drawing Sheets

U.S. PATENT DOCUMENTS

| | | | | |
|---|---|---|---|---|
| 6,630,916 | B1 | 10/2003 | Shinoda | 345/60 |
| 6,674,238 | B2 * | 1/2004 | Otani et al. | 313/587 |
| 6,683,589 | B2 * | 1/2004 | Sano et al. | 313/582 |
| 6,707,436 | B2 | 3/2004 | Setoguchi et al. | 345/60 |
| 6,753,645 | B2 * | 6/2004 | Haruki et al. | 313/582 |
| 2006/0076890 | A1 * | 4/2006 | Hong et al. | 313/582 |

FOREIGN PATENT DOCUMENTS

| | | | |
|---|---|---|---|
| JP | 2845183 | | 10/1998 |
| JP | 2917279 | | 4/1999 |
| JP | 2001-043804 | | 2/2001 |
| JP | 2001-325888 | | 11/2001 |
| KR | 10-2003-0054956 | | 7/2003 |
| KR | 2003054956 | A * | 7/2003 |

* cited by examiner

PLASMA DISPLAY PANEL DESIGN THAT COMPENSATES FOR DIFFERING SURFACE POTENTIAL OF COLORED FLUORESCENT MATERIAL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 7 Jul. 2004 and there duly assigned Serial No. 10-2004-0052606.

BACKGROUND OF THE INVENTION

1. Field of the Invention

The present invention pertains to a plasma display panel (PDP) having an enhanced structure capable of preventing faulty discharge and non-uniform discharge by allowing for the application of uniform address voltages to be applied to all subpixels.

2. Description of Related Art

Recently, PDPs are becoming increasingly popular as next generation large flat panel displays because of the PDP's large screen size, high image quality, thin thickness, light weight, and wide viewing angle. Even more so, the large sized PDP can be more easily manufactured by a more simpler methods than other display apparatuses.

The PDPs are classified into either a direct type, an alternating type or a hybrid of the two types based on the waveform of voltage applied to the electrodes. In addition, PDPs can be further classified into a facing discharge type and a surface discharge type based on the electrode structures. Recently, three-electrode surface discharge type AC-type PDPs have been widely provided.

In a PDP, there are red (R), green (G) and blue (B) subpixels containing red fluorescent material, green fluorescent material and blue fluorescent material respectively. However, the surface potential of the green fluorescent material is negative while the surface potential of each of the red and the blue fluorescent material is positive. Therefore, if the same voltages are applied to each of the red, blue and green subpixels during address discharge, different amounts of wall charges accumulate in the green subpixels than in the red or the blue subpixels. This variation in the amount of accumulated wall charges during the address discharge results in a faulty and non-uniform sustain discharge. Therefore, what is needed is a design for a PDP that will compensate for the differing surface potential of the differently colored fluorescent material.

SUMMARY OF THE INVENTION

It is therefore an object of the present invention to provide an improved design for a plasma display panel (PDP).

It is also an object of the present invention to provide a design for a PDP that compensates for the varying surface potential of the differently colored fluorescent materials.

It is still an object of the present invention to produce a design for a PDP that allows for the application of uniform address voltages for the differently colored subpixels.

It is still an object of the present invention to provide a design for a PDP that is capable of preventing faulty discharge and non-uniform discharge by accumulating the same amount of wall charges during the address discharge for each of the red, blue and green subpixels.

It is further an object of the present invention to provide a design for a PDP that has improved color purity and less deterioration of the fluorescent material.

These and other objects can be achieved by a PDP that has an upper substrate, a lower substrate opposite to the upper substrate, an upper dielectric layer formed on the upper substrate and a lower dielectric layer formed on the lower substrate, partition walls located between the upper and lower substrates, the partition walls dividing a space between the upper substrate and the lower substrate into a plurality of subpixels, a positive surface potential material located on at least an upper portion of the partition walls, discharge sustain electrode pairs located within the upper dielectric layer and extending in one direction over a row of subpixels, each of the discharge sustain electrode pairs are made up of a sustain electrode and a scan electrode, address electrodes within the lower dielectric layer and extending to intersect the discharge sustain electrode pairs, red, green, and blue fluorescent material coated in the respective red, green and blue subpixels and a discharge gas sealed within the subpixels.

The partition walls can include horizontal partition walls extending in the one direction parallel to the discharge sustain electrode pairs and vertical partition walls intersecting the horizontal partition wall to form a closed matrix-type shape for the subpixels, the positive surface potential material can be located on the horizontal partition walls. In addition, grooves can be formed on the horizontal partition walls, and at least the grooves can be filled with the positive surface potential material. In addition, a thickness of the positive surface potential material can be in a range of 3 to 13 μm, and a lateral spacing between the scan electrode and the adjacent horizontal partition wall can be in a range of 40 to 200 μm. In addition, the positive surface potential material can be made of $YBO_3$:Tb. The green fluorescent material can be a fluorescent material made of zinc silicate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
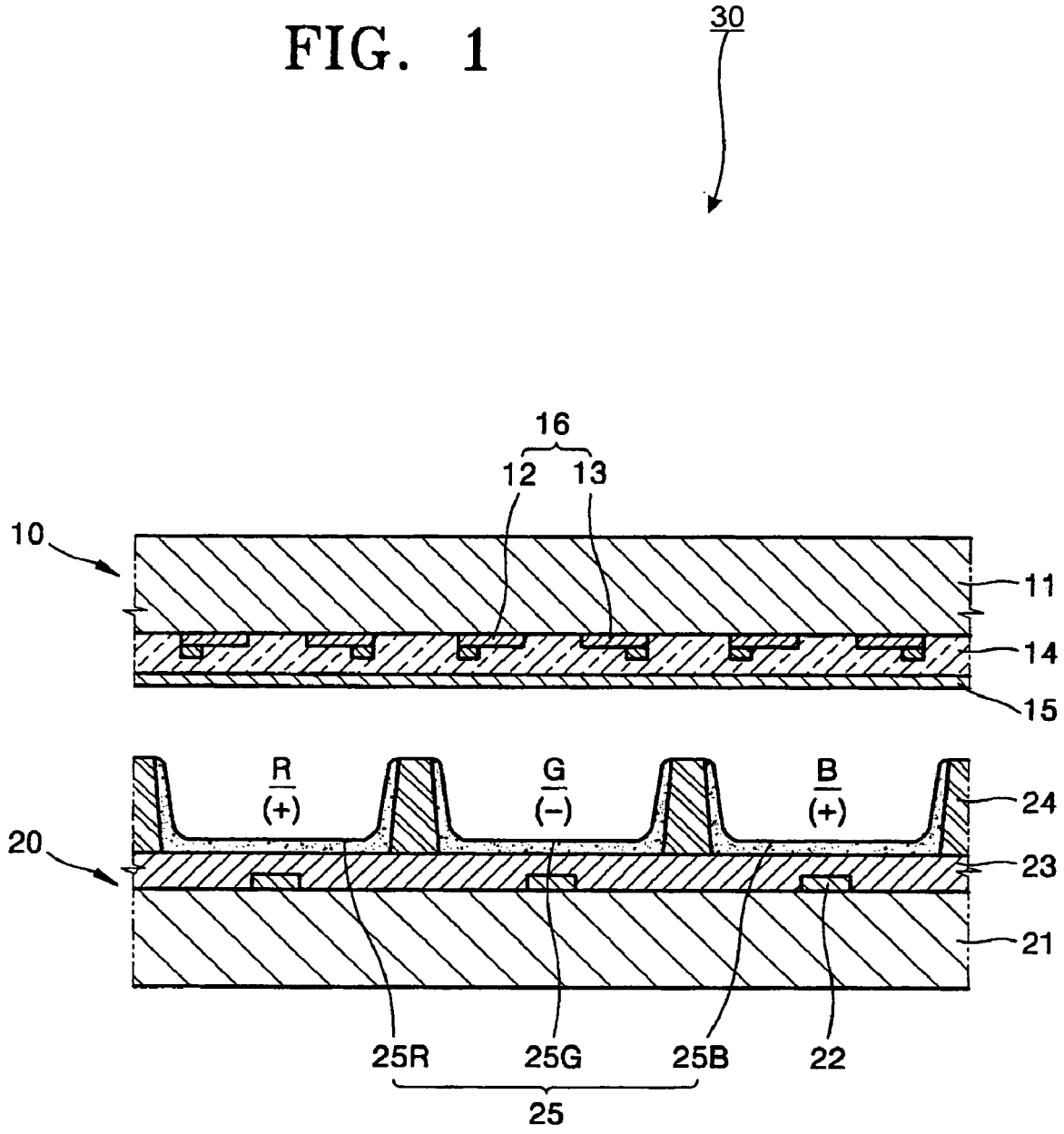
FIG. 1 is a cross sectional view illustrating a PDP.

Turning now to the figures, FIG. 1 is a cross sectional view illustrating a three-electrode surface discharge type plasma display panel (PDP) 30. The PDP 30 includes an upper panel 10 and a lower panel 20 opposite to the upper panel 10. In FIG. 1, the upper panel 10 is rotated by 90 degrees with respect to the lower panel 20 for the convenience of viewing and explanation.

The upper panel 10 includes an upper substrate 11, a plurality of discharge sustain electrode pairs 16 located on a bottom surface of the upper substrate 11, an upper dielectric layer 14 covering the discharge sustain electrode pairs 16 formed on the upper substrate 11, and a protective layer 15 for covering the upper dielectric layer 14. One electrode of the discharge sustain electrode pair 16 is referred to as a sustain electrode 12 and the other is referred to as a scan electrode 13.

The lower panel 20 includes a lower substrate 21, address electrodes 22 located on the lower substrate 21 and oriented in a direction that intersects the discharge sustain electrode pairs 16, a lower dielectric layer 23 covering the address electrodes 22 and covering an upper surface of the lower substrate 21, and partition walls 24 located on the lower dielectric layer 23. The partition walls 24 divide a space between the upper substrate 11 and the lower substrate 22 into a plurality of red (R), blue (B) and green (G) subpixels. Red, blue and green fluorescent material 25 is coated on the bottom surface of the R, B, and G subpixels respectively and on the side surfaces of the partition walls 24 within the R, B and G subpixels respectively. The fluorescent material 25 serves to convert vacuum ultraviolet light emitted from plasma discharge into visible light. Red, green, and blue fluorescent material 25R, 25G, and 25B respectively are coated in the respective subpixels R, G, and B. These subpixels are classified into red, green, and blue fluorescent subpixels R, G, and B according to the color of the fluorescent material coated therein (i.e., 25R, 25G, and 25B respectively). Discharge gas fills the subpixels and is sealed within the subpixels.

When an address voltage is applied between the address electrode 22 and the scan electrode 13, an address discharge is generated. During the address discharge, a subpixel for sustain discharge is selected by accumulating wall charges in the selected subpixel. Next, when an alternating current (AC) sustain discharge voltage is applied between the sustain electrode 12 and the scan electrode 13, a sustain discharge is generated in the previously selected subpixel between the sustain electrode 12 and the scan electrode 13. When an energy level of discharge gas excited by the sustain discharge is lowered, ultraviolet light is emitted. In turn, the ultraviolet light excites the fluorescent material 25 coated within the subpixels. When the energy level of the excited fluorescent material 25 is lowered, visible light is emitted. The emitted visible light is used to form an image.

The green fluorescent material 25G can be made of a zinc silicate such as $Zn_2SiO_4$:Mn. The surface potential of the green fluorescent material 25G is negative, while the surface potential of each of the red fluorescent material 25R and the blue fluorescent material 25B is positive. Since positive surface potential fluorescent material 25 is coated in the red and blue fluorescent subpixels R and B, the address voltages of the red and blue fluorescent subpixels R and B increase during an address discharge. However, since the negative fluorescent material 25 is coated in the green fluorescent subpixel G, the address voltage of the green fluorescent subpixel G decreases during the address discharge. Therefore, a higher voltage must be applied to the green fluorescent subpixel G than to the red and blue fluorescent subpixels R and B to achieve uniform address discharge for each of the red, blue and green subpixels. For example, to achieve a uniform address discharge for each subpixel, the address voltage applied to the red and blue fluorescent subpixels R and B is in a range of about 165 to 190 V while the address voltage applied to the green fluorescent subpixels G is in a range of about 175 to 190V. If instead the same voltage is applied to each subpixel, sufficient wall charges are not generated in the green fluorescent subpixel G. When an insufficient amount of wall charges are generated in the green subpixel G, a faulty sustain discharge or non-uniform sustain discharge results.

Figure 2:
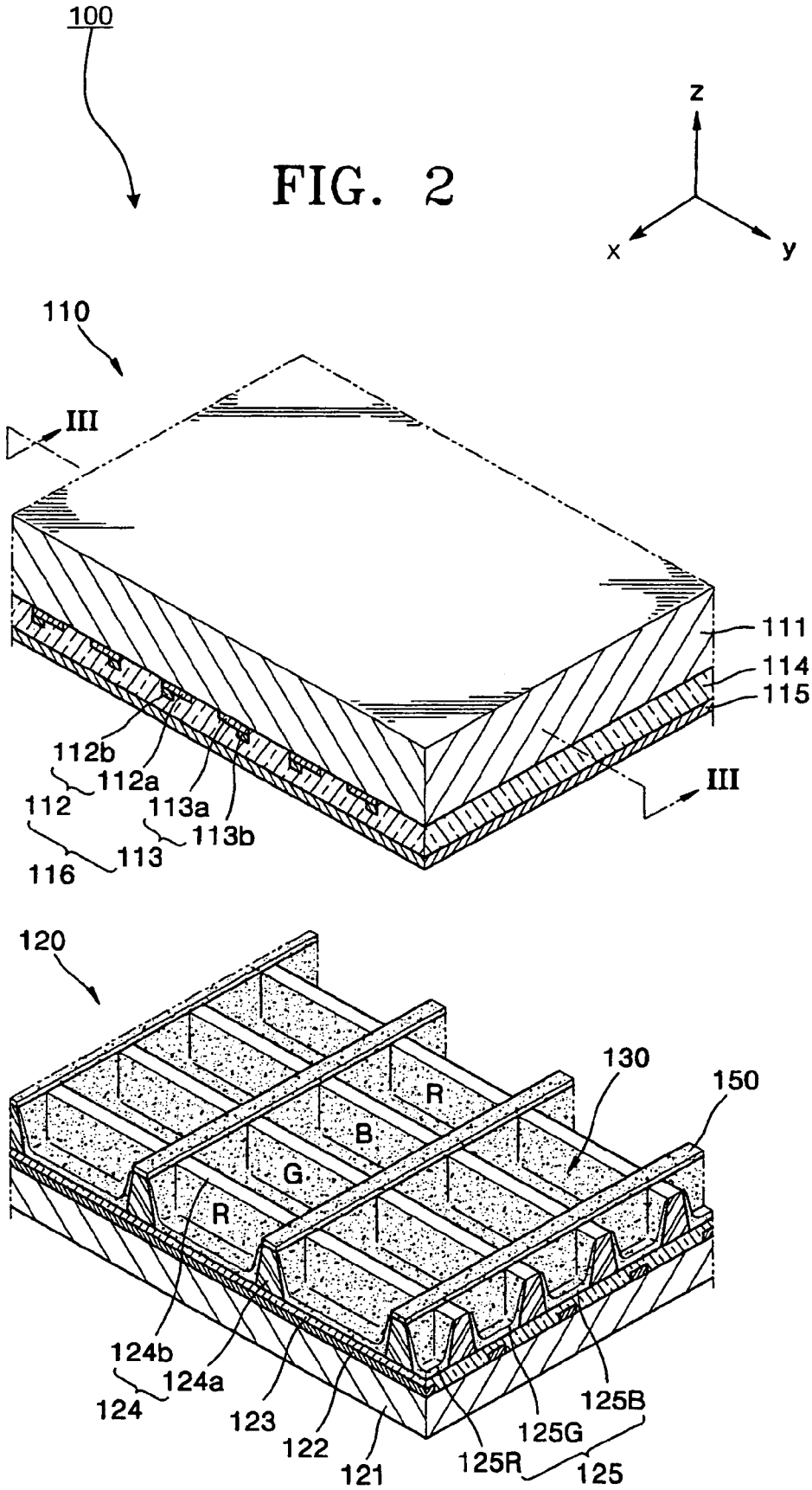
FIG. 2 is an exploded perspective view illustrating a PDP according to a first embodiment of the present invention.
Figure 3:
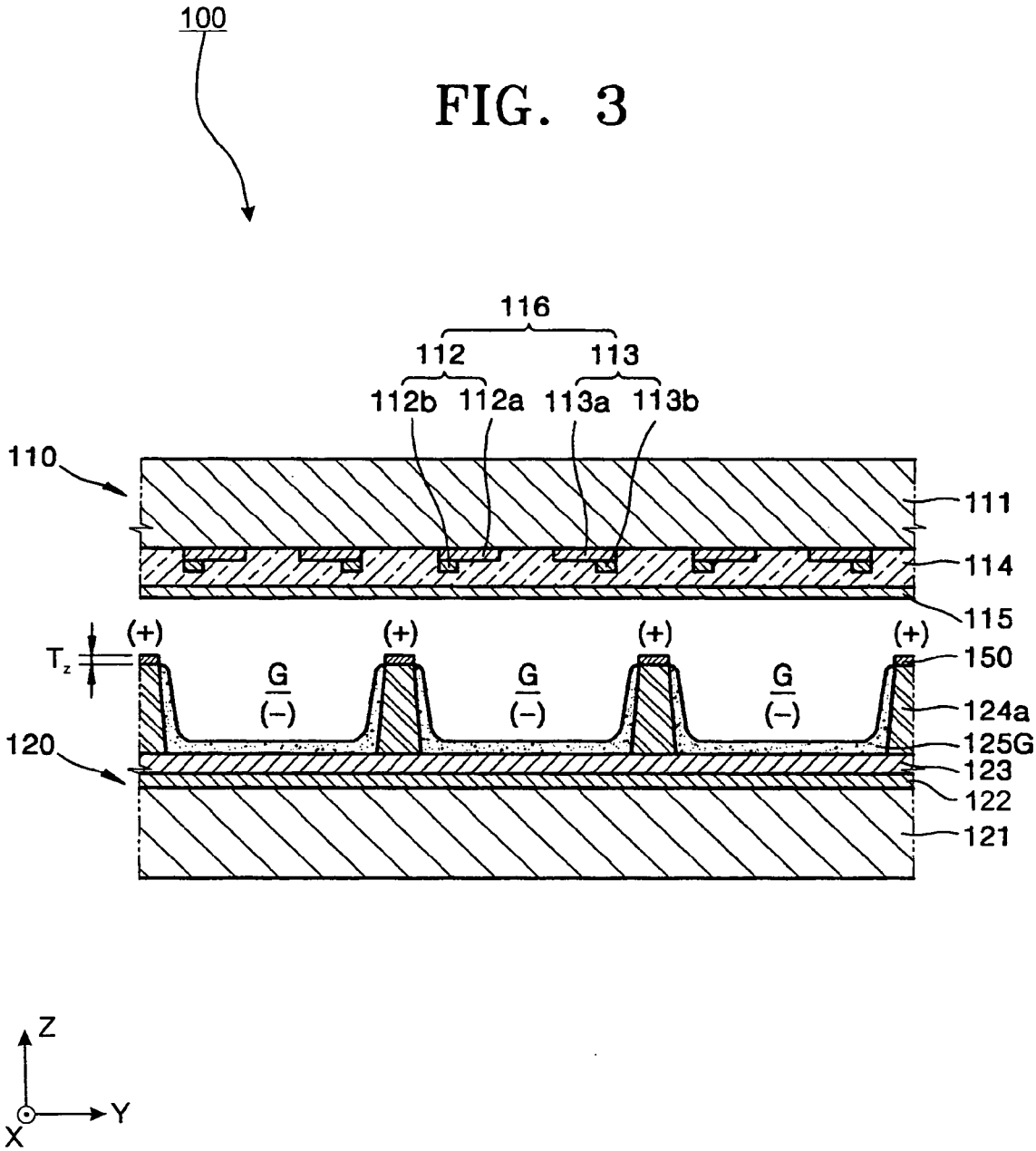
FIG. 3 is a cross sectional view taken along line III-III of the PDP illustrated in FIG. 2.
Figure 5:
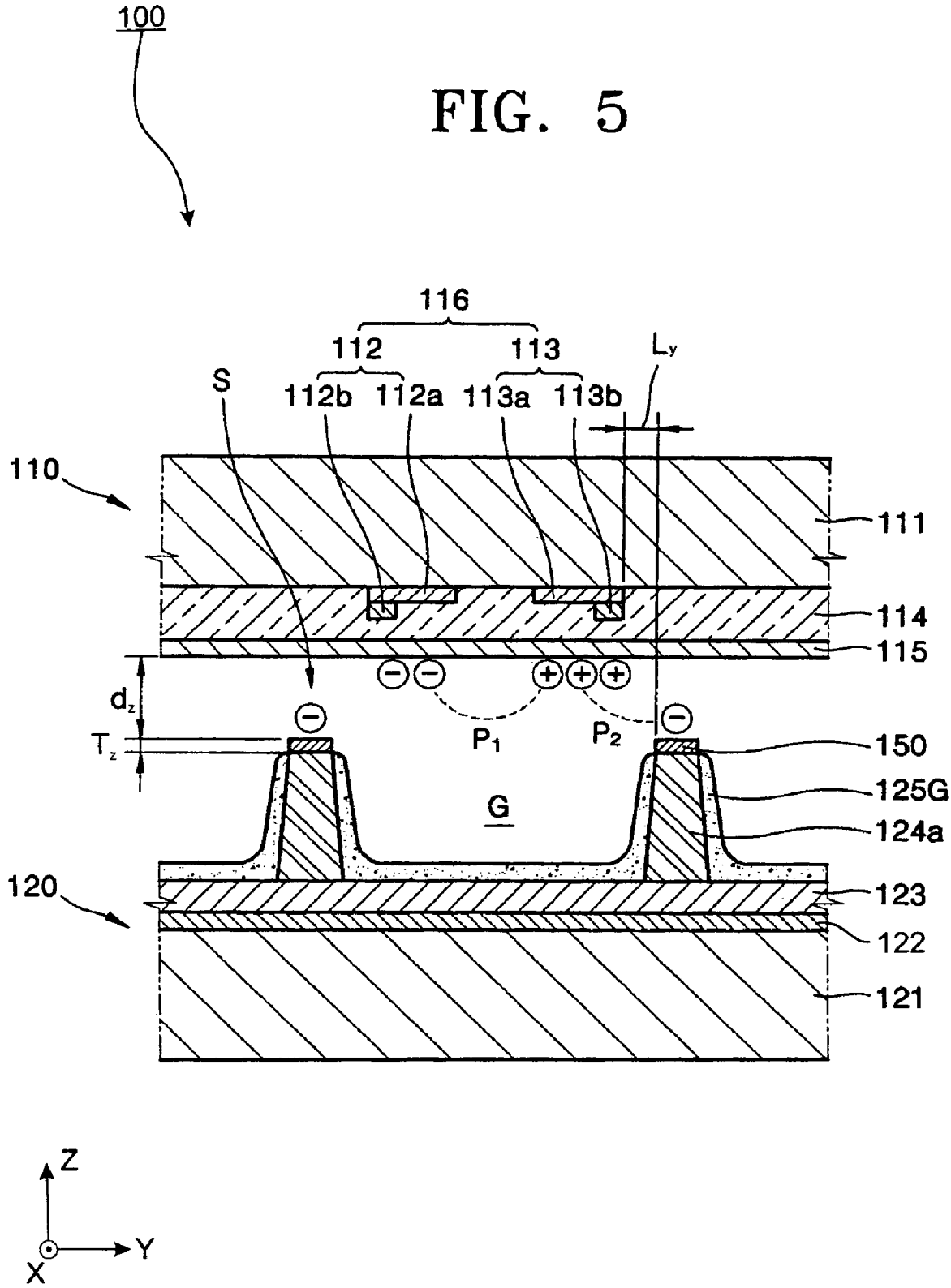
FIG. 5 is a cross sectional view of the PDP illustrated in FIG. 2 explaining electrical wall charge distribution just after the address discharge.

Turning now to FIGS. 2, 3 and 5, FIGS. 2, 3 and 5 illustrate PDP 100 according to a first embodiment of the present invention. Starting with FIG. 2, FIG. 2 is an exploded perspective view illustrating the PDP 100 according to the first embodiment of the present invention. PDP 100 includes an upper panel 110 and a lower panel 120 opposite to the upper panel 110. The upper panel 110 includes an upper substrate 111, a plurality of discharge sustain electrode pairs 116 formed in a predetermined pattern on a bottom surface of the upper substrate 111, an upper dielectric layer 114 covering the discharge sustain electrode pairs 116 and the bottom surface of the upper substrate, and a protective layer 115 for covering the upper dielectric layer 114.

Typically, the upper substrate 111 is made of a transparent material such as glass. The discharge sustain electrode pairs 116 are formed parallel to each other and spaced apart from each other by a predetermined distance on a bottom or inner side of the upper substrate 111. The discharge sustain electrode pairs 116 generate the main or sustain discharge. One electrode of the discharge sustain electrode pair 116 is referred to as a sustain electrode 112 and the other electrode of the pair is referred to as a scan electrode 113.

Often, each of the sustain electrode 112 and the scan electrode 113 includes both a transparent electrode 112*a*, 113*a* and a bus electrode 112*b*, 113*b* respectively. In some case, the sustain electrode 112 and the scan electrode 113 can include only the bus electrode without the transparent electrode. The transparent electrodes 112*a* and 113*a* are made of a transparent conductive material capable of generating discharge while allowing light to be transmitted therethrough from the subpixels. Typically, the transparent conductive material is indium tin oxide (ITO). The bus electrodes 112*b* and 113*b* are made of a non-transparent, highly conductive metal and are located at side portions of the transparent electrodes 112*a* and 113*a*, respectively. The bus electrodes 112*b* and 113*b* have the function of increasing electrical conductivity of the discharge sustain electrode pairs 116. The bus electrodes 112*b* and 113*b* can be formed as a single metal layer of aluminum or silver or as a triple metal layer such as chromium/copper/chromium.

The upper dielectric layer 114 prevents the sustain electrode 112 and the scan electrode 113 from directly conducting. In addition, the upper dielectric layer 114 also prevents the discharge sustain electrode pairs 116 from damage from colliding with positive ions or electrons during a sustain discharge. In addition, the upper dielectric layer 114 has a function of inducing charges to accumulate as wall charges. The upper dielectric layer 114 can be made of a dielectric material such as PbO, $B_2O_3$, and $SiO_2$.

Although the protective layer 115 is not a requisite component, it is preferable that the protective layer 115 is provided. The protective layer 115 prevents the upper dielectric layer 114 from damage from colliding with positive ions or electrons during a sustain discharge while allowing for more secondary electrons to be emitted. The protective layer 115 is often made of MgO.

The lower panel 120 includes a lower substrate 121, a plurality of address electrodes 122 located on an upper or inner surface of the lower substrate 121, a lower dielectric layer 123 covering the address electrodes 122 and the upper surface of the lower substrate, partition walls 124 located on the lower dielectric layer 123 to define the plurality of subpixels 130, and fluorescent material 125 coated within the subpixels 130.

The lower substrate 121 has the function of supporting the address electrodes 122 and the lower dielectric layer 123. The lower substrate 121 is often made of a material mainly containing glass. The address electrodes 122 are used to generate an address discharge which in turn is used to facilitate the main or sustain discharge between the sustain electrode 112 and the scan electrode 113 by lowering the voltage needed to achieve the main discharge. The address electrodes 122 extend in stripe pattern in the y direction to intersect the discharge sustain electrode pairs 116, as illustrated in FIG. 2. The lower dielectric layer 123 prevents the address electrodes 122 from damage from colliding with positive ions or electrons during a sustain discharge. The lower dielectric layer 123 can be made of a dielectric material such as PbO, $B_2O_3$, and $SiO_2$.

As illustrated in FIG. 2, the partition walls 124 include horizontal and vertical partition walls 124*a* and 124*b* extending in the x and y directions, respectively. The partition walls 124 in FIG. 2 have the shape of a matrix. The partition walls 124 define the plurality of the subpixels 130, that is, discharge spaces between the upper and lower substrates 111 and 121 and prevent optical and electrical crosstalk between neighboring subpixels 130.

According to the present invention, a positive surface potential material 150 having a positive surface potential is located on at least some portion of the partition walls 124. For example, as illustrated in FIG. 3, the positive surface potential material 150 can be located on the tops of the horizontal partition walls 124*a*. The positive surface potential material 150 can be made of a green fluorescent material 125G such as $YBO_3$:Tb having a positive surface potential. The positive surface potential material 150 has a function of neutralizing the negative surface potential of the zinc silicate green fluorescent material 125G, so that sufficient wall charges can be generated in the green fluorescent subpixel G during the address discharge. As a result, in the subsequent sustain discharge, a faulty discharge and non-uniform discharge can be prevented. On the other hand, the positive surface potential material 150 can be formed by various coating methods such as an ejection method. In the ejection method, a positive fluorescent paste is ejected onto the horizontal partition walls 124*a* through dispenser nozzles.

Figure 4:
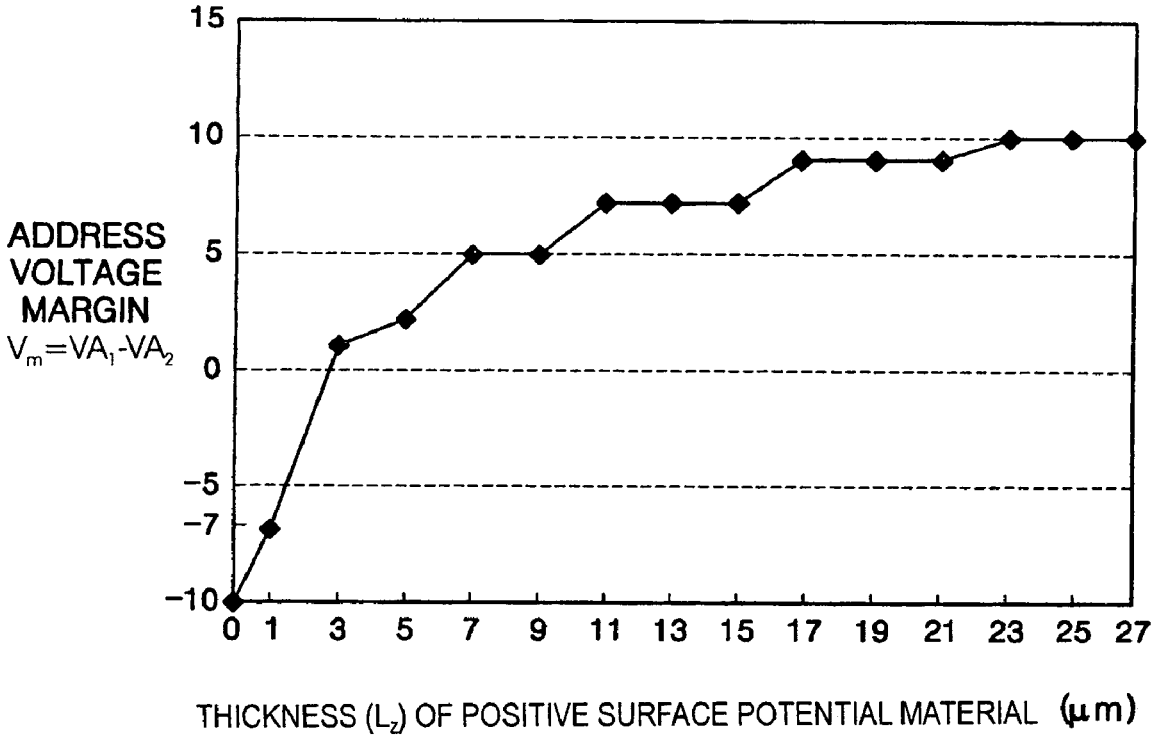
FIG. 4 is a graph illustrating an address voltage margin depending on the thickness of the positive surface potential material.

The positive surface potential material 150 must have a thickness of at least $T_z$. If the positive surface potential material 150 is too thin, the positive surface potential material 150 cannot neutralize the negative surface potential of the zinc silicate green fluorescent material 125G. FIG. 4 illustrates an empirical results of address voltage margin $V_m=VA_1-VA_2$ with respect to the thickness $T_z$ of the positive surface potential material 150. In the experiment, the address voltage margin $V_m=VA_1-VA_2$ is measured with respect to the thickness $T_z$ of the positive surface potential material 150. Here, the address voltage margin $V_m=VA_1-VA_2$ denotes a difference between the address voltage $VA_1$ for address discharge in the red or blue fluorescent subpixel R or B and the address voltage $VA_2$ for address discharge in the green fluorescent subpixel G. In the experiment, the positive surface potential material 150 is made of $YBO_3$:Tb and the green fluorescent material 125G is made of $Zn_2SiO_4$:Mn.

As illustrated in FIG. 4, in a case where the positive surface potential material 150 is not provided (i.e., T=0 μm), the address voltage margin $V_m=VA_1-VA_2$ is −10V. As the thickness $T_z$ of the positive surface potential material 150 increases, the address voltage margin $V_m$ also increases (becomes more positive) and approaches zero and then exceeds zero. In a case where the thickness $T_z$ of the positive surface potential material 150 is 3 μm or less, the address voltage margin $V_m=VA_1-VA_2$ remains below zero. When the address voltage margin $V_m$ is negative, a higher address voltage must be applied to the green fluorescent subpixel G than to either the red or blue fluorescent subpixels R and B in order to obtain a uniform address discharge. This is because the positive surface potential material 150 cannot fully neutralize the negative surface potential on the zinc silicate green fluorescent material 125G when the thickness $T_z$ of the positive surface potential material 150 is 3 μm or less. Therefore, it is preferable that the thickness $T_z$ of the positive surface potential material 150 be at least 3 μm.

Turning now to FIG. 5, FIG. 5 is a cross sectional view of the PDP 100 of FIG. 2 illustrating the wall charge distribution in green subpixels after the address discharge as well as the interaction of the wall charges with each other. As illustrated in FIG. 5, the positive surface potential material 150 is located on the tops of the horizontal partition walls 124*a*. Referring to FIG. 5, as a result of the address discharge, positive and negative wall charges accumulate near the scan electrode 113 and the sustain electrode 112, respectively. Since the positive surface potential material 150 located on the horizontal partition walls 124*a* has a tendency to be positively charged, negative wall charges are attracted to and thus accumulate on the positive surface potential material 150 located on the horizontal partition walls 124*a* as illustrated in FIG. 5.

Generally, gap S exists between the positive surface potential material 150 and the upper panel 110. The gap S occurs because each partition wall 124 is not formed to the exact same height due to tolerances in the manufacturing process. In the gap space S, a discharge $P_2$ can occur between the scan electrode 113 and the positive surface potential material 150. As described above, since positive and negative wall charges are accumulated on the scan electrode 113 and the positive surface potential material 150 located on the horizontal partition walls 124*a*, respectively, when the sustain discharge voltage is applied to the scan electrode 113, the discharge $P_2$ can occur between the scan electrode 113 and the positive surface potential material 150. In this case, a weaker discharge $P_1$ can also occur between the sustain electrode 112 and the scan electrode 113, preventing sufficient brightness from being obtained. In the worst case scenario, no sustain discharge occurs because of faulty discharges $P_1$ and $P_2$.

In the first embodiment, in order to prevent the faulty discharge $P_2$ between the positive surface potential material 150 and the scan electrode 113, the lateral spacing (i.e., the separation in the y-direction) between the scan electrode 113 and the positive surface potential material 150 is designed to be at least a predetermined distance $L_y$ apart. Since it is preferable that the designed distance $L_y$ varies depending on the height (or thickness) $T_z$ of the positive surface potential material 150, the thickness $T_z$ of the positive surface potential material 150 and the lateral separation $L_y$ between the scan electrode 113 and the positive surface potential material 150 are selected as design parameters. Since a gap distance $d_z$ between the positive surface potential material 150 and the upper panel 110 occurs because of manufacturing tolerances or errors, the gap distance $d_z$ cannot be artificially controlled as a design parameter.

Figure 6:
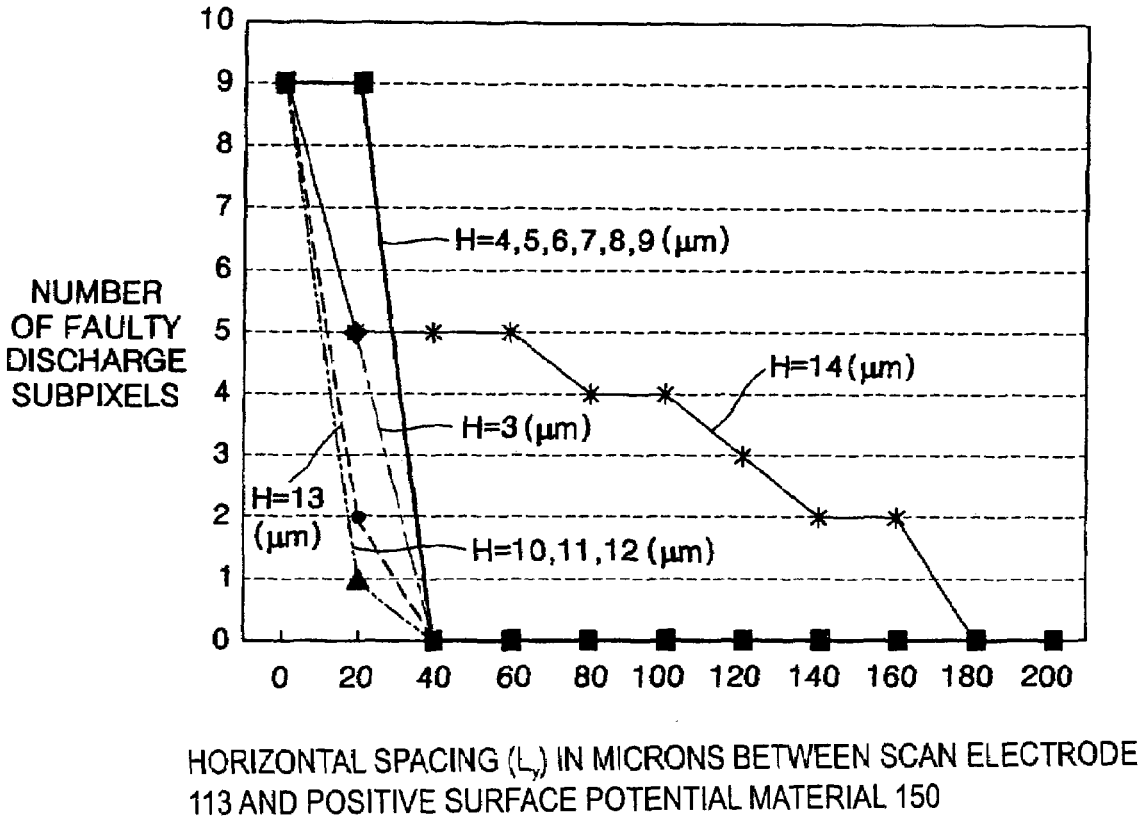
FIG. 6 is a graph illustrating the number of faulty-discharging subpixels depending on both the thickness of the positive surface potential material and the lateral spacing distance between a scan electrode and positive surface potential material layer.

The thickness $T_z$ of the positive surface potential material 150 and the lateral spacing $L_y$ between the scan electrode 113 and the positive surface potential material 150 can be selected based on the empirical data illustrated in FIG. 6. In FIG. 6, the number of faulty green subpixels out of 9 subpixels is illustrated based on various combinations of thickness $T_z$ of the positive surface potential material and the lateral spacing $L_y$ between the scan electrode 113 and the positive surface potential material 150. Thus, the number of faulty pixels out of 9 possible green subpixles is a function of both $T_z$ and $L_y$. In the experiment, as the thickness $T_z$ of the positive surface potential material 150 varies from 3 to 14 μm, the number of subpixels generating faulty discharge is counted. If the thickness $T_z$ of the positive surface potential material 150 is lower than the lower limit of 3 μm, the positive surface potential material 150 cannot fully neutralize the negative surface potential created by the green fluorescent material 125G (see FIG. 4)

In the experiment, 3×3=9 green fluorescent subpixels G are used. As the thickness $T_z$ of the positive surface potential material 150 and the lateral spacing $L_y$ between the scan electrode 113 and the positive surface potential material 150 vary, the number of subpixels generating faulty discharge is counted. Here, the faulty discharge denotes a discharge providing insufficient brightness or no discharge at all.

As illustrated in FIG. 6, for the range of the thickness $T_z$ of the positive surface potential material 150 ($T_z$=3~14 μm), as the lateral spacing $L_y$ increases, the number of subpixels generating faulty discharge always decreases. More specifically, in a case where the thickness $T_z$ of the positive surface potential material 150 is between 3 and 13 μm, as the lateral spacing $L_y$ increases from 0 to 40 μm, the number of subpixels generating faulty discharge rapidly decreases. If the lateral spacing $L_y$ is 40 μm or more, faulty discharge is not generated for positive surface potential material thicknesses $T_z$ between 3 and 13 μm, meaning that sufficient sustain discharge can be generated in all the 9 subpixels. In a case where the thickness $T_z$ of the positive surface potential material 150 is 14 μm, as the lateral spacing $L_y$ increases from 0 to 180 μm, the number of subpixels generating faulty discharge gradually decreases. If the lateral spacing $L_y$ is 180 μm or more, a faulty discharge is not generated when $T_z$ is 14 μm.

For the results of the empirical data of FIG. 6, it is preferable that the thickness $T_z$ of the positive surface potential material 150 be from 3 to 13 μm and the lateral spacing $L_y$ between the scan electrode 113 and the positive surface potential material 150 be 40 μm or more in order to prevent faulty discharge. In addition, in a case where the thickness $T_z$ of the positive surface potential material 150 is 14 μm, if the lateral spacing $L_y$ is 180 μm or more, the faulty discharge can also be prevented. However, considering that it is preferable in view of emission efficiency that the lateral spacing $L_y$(i.e., distance in the y direction between the scan electrode 113 and the positive surface potential material 150) be maintained at 180 μm or less, the thickness $T_z$ of the positive surface potential material 150 is preferably in a range of 3 to 13 μm.

On the other hand, the lateral spacing $L_y$ between the scan electrode 113 and the positive surface potential material 150 can be maintained constant between the sustain electrode 112 and the adjacent positive surface potential material 150. In this case, since the sustain electrode 112 and the scan electrode 113 are located along the centers of the subpixels 130, electric fields are focused on the centers of the subpixels 130 to efficiently generate plasma, so that it is possible to prevent the plasma from disappearing due to the collision with partition walls 124.

Returning to FIG. 2, the fluorescent material 125 is coated on the bottom surface of the subpixels R, G, and B and the side surfaces of the partition walls 124. Although not illustrated in the figures, in addition to the fluorescent material being within the subpixels, a discharge gas such as Ne, Xe or a mixture thereof is sealed within the subpixels 130. The subpixels 130 are classified into red, green, and blue fluorescent subpixels R, G, and B according to the color of the coated fluorescent material 125R, 125G, and 125B. The fluorescent material 125 has the function of converting vacuum ultraviolet light generated in the plasma during the sustain discharge into visible light. For example, the fluorescent material 125R and 125B can be made of $Y(V,P)O_4$:Eu and BAM:Eu, respectively. In addition, the green fluorescent material 125G can be made of zinc silicate such as $Zn_2SiO_4$:Mn. According to the present invention, since the faulty discharge due to a polarity of a surface potential can be prevented, the green fluorescent material made of zinc silicate having a negative surface potential can still be used. As a result, color purity of the fluorescent material can be maintained at a high level and deterioration thereof can be reduced. Therefore, it is possible to improve the brightness and the length of the life of the plasma display panel.

Figure 7:
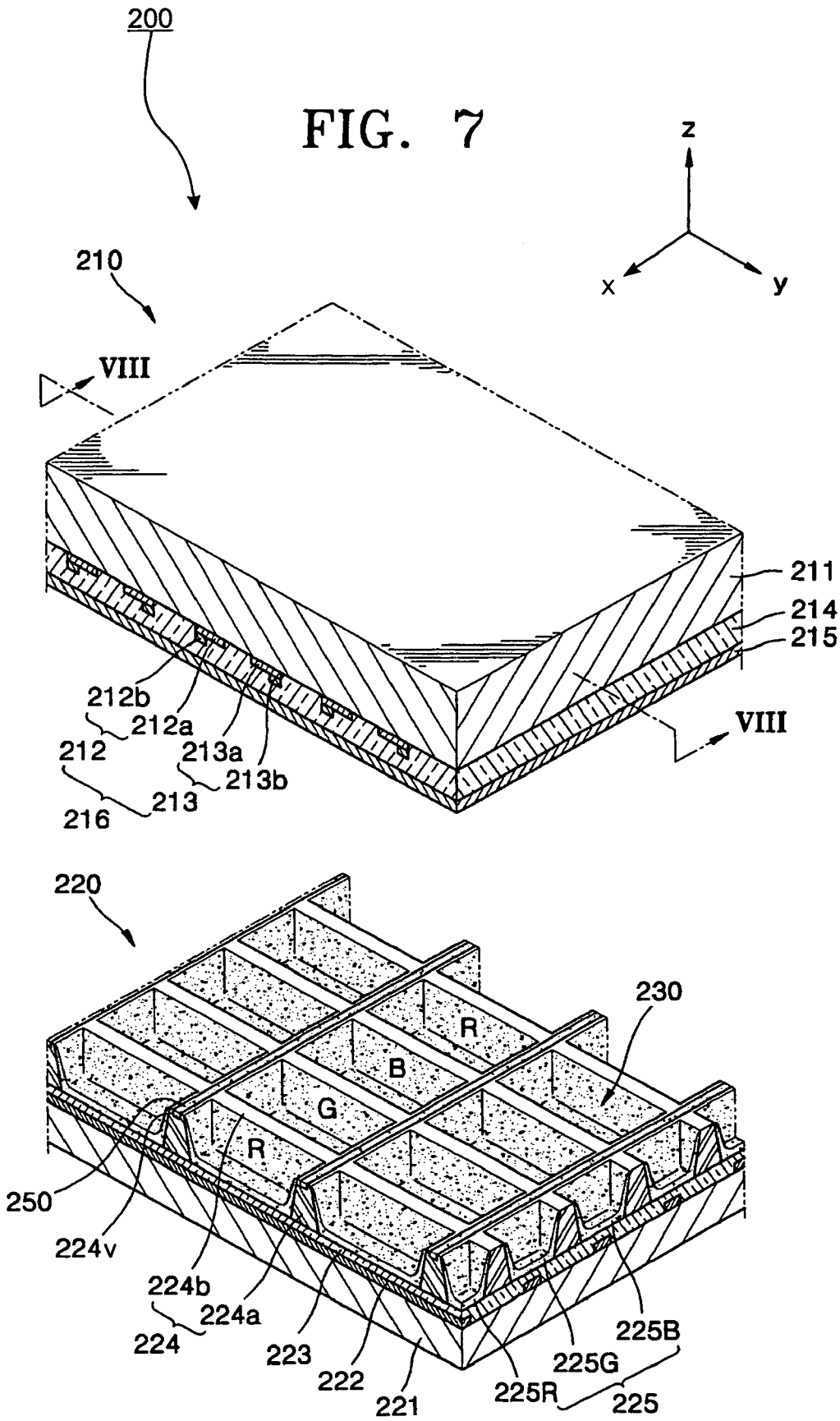
FIG. 7 is an exploded perspective view illustrating a PDP according to a second embodiment of the present invention.
Figure 8:
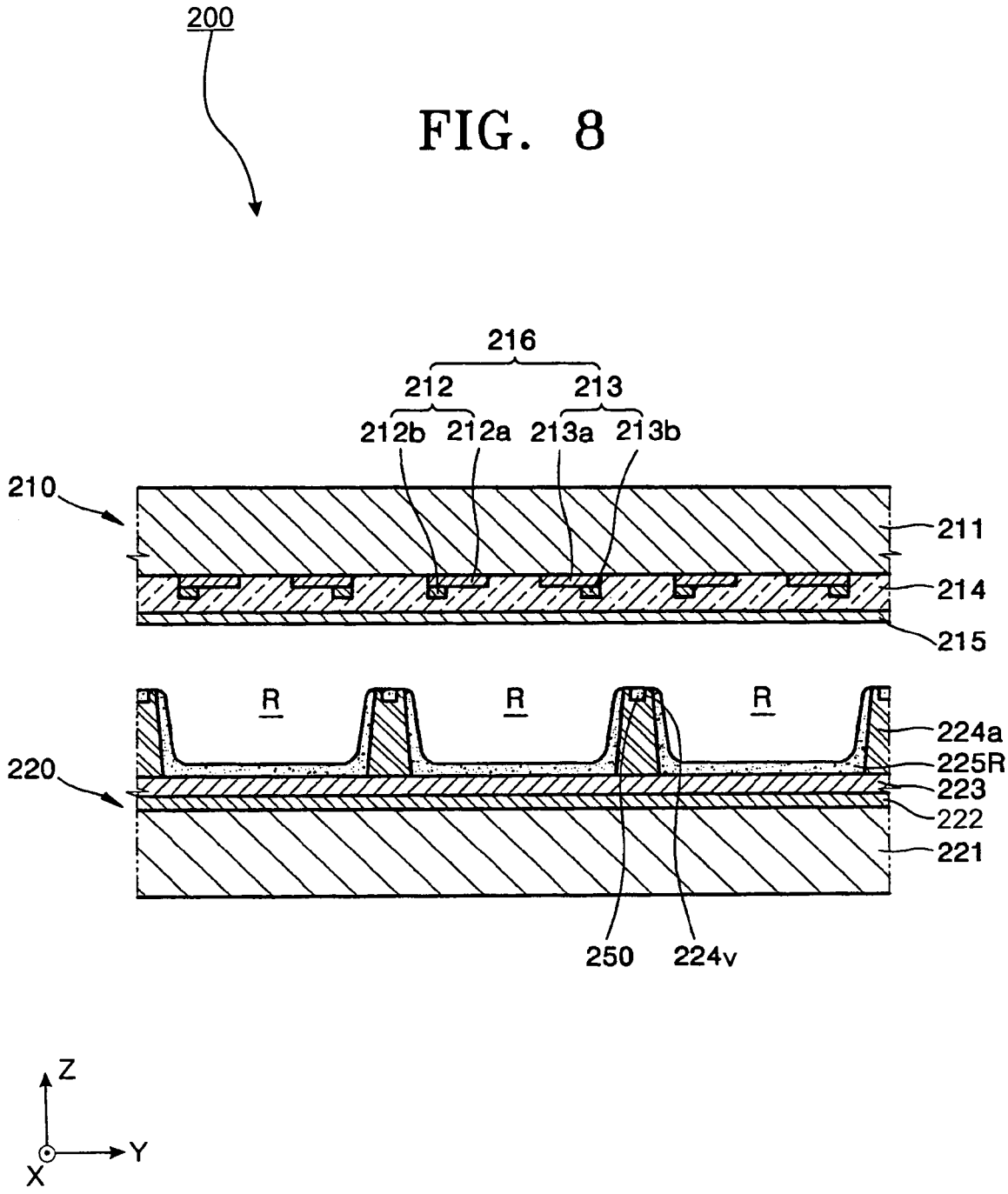
FIG. 8 is a cross sectional view taken along line VIII-VIII of the PDP illustrated in FIG. 7.

Turning now to FIGS. 7 and 8, FIGS. 7 and 8 illustrate a PDP 200 according to a second embodiment of the present invention. FIG. 7 is an exploded perspective view of PDP 200 and FIG. 8 is a cross sectional view of PDP 200 taken along line VIII-VIII of FIG. 7. The PDP 200 according to the second embodiment has the same components, operations, and effects as that of PDP 100 according to the first embodiment illustrated in FIGS. 2 and 3 except for the following description.

Referring to FIGS. 7 and 8, partition walls 224 of the second embodiment also include horizontal and vertical partition walls 224*a* and 224*b*. Unlike the first embodiment, grooves 224*v* are formed on the horizontal partition walls 224*a*. The grooves 224*v* are filled with the positive surface potential material 250. The positive surface potential material 250 can be made of a green fluorescent material such as $YBO_3$:Tb having a positive surface potential. In the second embodiment, since the grooves 224*v* are filled with positive surface potential material 250, it is possible to prevent the positive surface potential material 250 from flowing into and mixing with different-color fluorescent material such as the red fluorescent material 225R and/or the blue fluorescent material 225B.

In addition, details of an upper panel 210, which includes an upper substrate 211, discharge sustain electrode pairs 216 each consisting of a sustain electrode 212 and a scan electrode 213, an upper dielectric layer 214, a protective layer 215, etc. and details of a lower panel 220, which includes an lower substrate 221, address electrodes 222, a lower dielectric layer 223, partition walls 224 to define a plurality of subpixels 230, fluorescent material 225, etc., in the second embodiment are substantially the same as in the first embodiment described above.

In summary, it is possible to obtain the following effects by the embodiments of the present invention. First, it is possible to lower an address voltage of a plasma display panel. Since a positive surface potential material having a positive surface potential is formed to have a predetermined thickness on partition walls, the positive surface potential material can neutralize the negative surface potential of the zinc silicate green fluorescent material. As a result, it is possible to efficiently address all subpixels with uniform address voltages and not have to compensate for negative surface potential by increasing the address voltage. Therefore, it is possible to prevent faulty discharge or non-uniform discharge while increasing address voltage margin $V_m$.

Second, since the zinc silicate green fluorescent material can still be used, it is possible to improve color purity of the fluorescent material and to reduce deterioration thereof. Therefore, it is possible to improve the brightness and the length of the life of the plasma display panel.

Third, it is possible to obtain a stable discharge and prevent faulty discharge by using a positive surface potential material located on the partition walls. In particular, when 1) thickness $T_z$ of the positive surface potential material and 2) lateral spacing $L_y$ between a discharge electrode and the positive surface potential material are selected as design parameters, it is possible to prevent faulty discharge $P_2$ from occurring between the discharge electrode and the positive surface potential material.

While the present invention has been particularly shown and described with reference to exemplary embodiments thereof, it will be understood by those skilled in the art that various changes in form and details can be made therein without departing from the spirit and scope of the present invention as defined by the appended claims.

What is claimed is:

1. A plasma display panel (PDP), comprising:

an upper substrate;

an upper dielectric layer arranged on the upper substrate;

a lower substrate arranged opposite to the upper substrate;

a lower dielectric layer arranged on the lower substrate;

partition walls arranged between the upper substrate and the lower substrate, the partition walls defining a plurality of subpixels together with the upper and lower substrate;

a positive surface potential material that comprises a green fluorescent material being arranged only between a top surface of the partition walls and the upper dielectric layer between adjacent ones of the plurality of subpixels;

discharge sustain electrode pairs arranged within the upper dielectric layer and extending over the subpixels and extending in a first direction, each discharge sustain electrode pair comprises a sustain electrode and a scan electrode;

address electrodes arranged within the lower dielectric layer and extending in a second and different direction to intersect the discharge sustain electrode pairs;

red, green, and blue fluorescent material arranged within the respective subpixels, the green fluorescent material arranged within the respective subpixels comprises a negative surface potential material, the green fluorescent layer comprising the negative fluorescent material being arranged only within the respective subpixels and not between ones of the subpixels; and a discharge gas arranged within the subpixels.

2. The PDP of claim 1, the partition walls include horizontal partition walls extending parallel to the discharge sustain electrode pairs and vertical partition walls intersecting the horizontal partition walls, the positive surface potential material being arranged on the top surfaces of the horizontal partition walls and not on the vertical partition walls.

3. A plasma display panel (PDP), comprising:

an upper substrate;

an upper dielectric layer arranged on the upper substrate;

a lower substrate arranged opposite to the upper substrate;

a lower dielectric layer arranged on the lower substrate;

partition walls arranged between the upper substrate and the lower substrate, the partition walls defining a plurality of subpixels together with the upper and lower substrate;

a positive surface potential material arranged between a top surface of the partition walls and the upper dielectric layer;

discharge sustain electrode pairs arranged within the upper dielectric layer and extending over the subpixels and extending in a first direction, each discharge sustain electrode pair comprises a sustain electrode and a scan electrode;

address electrodes arranged within the lower dielectric layer and extending in a second and different direction to intersect the discharge sustain electrode pairs;

red, green, and blue fluorescent material arranged within the respective subpixels; and a discharge gas arranged within the subpixels, wherein the partition walls include horizontal partition walls extending parallel to the discharge sustain electrode pairs and vertical partition walls intersecting the horizontal partition walls, the positive surface potential material being arranged on the top surfaces of the horizontal partition walls, grooves being arranged in the horizontal partition walls, the grooves being filled with the positive surface potential material.

4. The PDP of claim 2, a thickness of the positive surface potential material being in a range of 3 to 13 μm, and a lateral spacing between a scan electrode and an adjacent positive surface potential material being in a range of 40 to 200 μm.

5. The PDP of claim 1, the positive surface potential material comprising $YBO_3$:Tb.

6. The PDP of claim 1, the green fluorescent material arranged within the respective subpixels comprising zinc silicate.

7. The PDP of claim 3, the positive surface potential material being a green fluorescent material.

8. The PDP of claim 1, the positive surface potential material being applied by an ejection depositing process.

9. A plasma display panel (PDP), comprising:

a transparent upper substrate;

sustain and scan electrode pairs arranged in a first direction on the transparent upper substrate;

an upper dielectric layer arranged over the sustain and scan electrode pairs and over an inner surface of the transparent upper substrate;

a lower substrate arranged opposite to the transparent upper substrate;

address electrodes arranged in a second and different direction on the lower substrate;

a lower dielectric layer arranged over the address electrodes and on an inner surface of the lower substrate;

partition walls arranged between the upper substrate and the lower substrate dividing a space between the upper substrate and the lower substrate into a plurality of subpixels, the plurality of subpixels including red, green and blue subpixels;

red, green, and blue fluorescent material arranged within respective red, green and blue subpixels; and a discharge gas arranged within the subpixels, wherein green fluorescent material arranged within the green subpixels comprises only a negative surface potential material, and wherein green fluorescent material comprising only a positive surface potential material being arranged on surfaces of the partition walls that face the transparent upper substrate and not within the green subpixels.

10. The PDP of claim 9, the partition walls comprising horizontal partition walls extending parallel to the sustain and scan electrode pairs and vertical partition walls extending parallel to the address electrodes, the green fluorescent material comprising the positive surface potential material being arranged only on the horizontal partition walls.

11. A plasma display panel (PDP), comprising:

a transparent upper substrate;

sustain and scan electrode pairs arranged in a first direction on the transparent upper substrate;

an upper dielectric layer arranged over the sustain and scan electrode pairs and over an inner surface of the transparent upper substrate;

a lower substrate arranged opposite to the transparent upper substrate;

address electrodes arranged in a second and different direction on the lower substrate;

a lower dielectric layer arranged over the address electrodes and on an inner surface of the lower substrate;

partition walls arranged between the upper substrate and the lower substrate dividing a space between the upper substrate and the lower substrate into a plurality of subpixels, the plurality of subpixels including red, green and blue subpixels;

a positive surface potential material arranged on surfaces of the partition walls that face the transparent upper substrate;

red, green, and blue fluorescent material arranged within respective red, green and blue subpixels; and a discharge gas arranged within the subpixels, wherein at least some of the surfaces of the partition walls that face the transparent upper substrate have a groove arranged therein, the positive surface potential material being arranged within the groove and between neighboring subpixels.

12. The PDP of claim 9, the positive surface potential material being arranged in a stripe pattern and running parallel to the sustain and scan electrode pairs.

13. The PDP of claim 12, a thickness of the positive surface potential material being between 3 and 13 microns and a lateral distance between each scan electrode and a corresponding positive surface potential material being between 40 and 180 microns.

14. The PDP of claim 9, the green fluorescent material comprising negative surface potential material comprises zinc silicate and the green fluorescent material comprising the positive surface potential material comprises $YBO_3$:Tb.

15. A plasma display panel (PDP), comprising:

a transparent upper substrate;

sustain and scan electrode pairs arranged in a first direction on the transparent upper substrate;

a lower substrate arranged opposite to the upper substrate;

address electrodes arranged in a second and different direction on the lower substrate;

partition walls arranged between the upper substrate and the lower substrate dividing a space between the upper substrate and the lower substrate into a plurality of subpixels, the plurality of subpixels including red, green and blue subpixels;

a red fluorescent material comprising at least one of the elements Y, 0, V, P and Eu and being arranged within the red subpixels, a blue fluorescent material comprising at least one of the elements Ba, Al, Mg and Eu and being arranged within the blue subpixels and a green fluorescent material comprising a negative surface potential material that comprises zinc silicate and being arranged within the green subpixels;

a positive surface potential material arranged between the partition walls and the transparent upper substrate, the positive surface potential material being arranged side-by-side with and not on top of or underneath the negative surface potential green fluorescent material; and a discharge gas arranged within the subpixels.

16. The PDP of claim 15, the positive surface potential material being arranged in stripes parallel to the sustain and scan electrode pairs, a lateral distance between each scan electrode and a corresponding stripe of positive surface potential material being between 40 and 180 microns.

17. The PDP of claim 15, a thickness of the positive surface potential material being between 3 and 13 microns.

18. The PDP of claim 15, the positive surface potential material comprising $YBO_3$:Tb.

19. A plasma display panel (PDP), comprising:

a transparent upper substrate;

sustain and scan electrode pairs arranged in a first direction on the transparent upper substrate;

a lower substrate arranged opposite to the upper substrate;

address electrodes arranged in a second and different direction on the lower substrate;

partition walls arranged between the upper substrate and the lower substrate dividing a space between the upper substrate and the lower substrate into a plurality of subpixels, the plurality of subpixels including red, green and blue subpixels;

a red fluorescent material comprising at least one of the elements Y, 0, V, P and Eu and being arranged within the red subpixels, a blue fluorescent material comprising at least one of the elements Ba, Al, Mg and Eu and being arranged within the blue subpixels and a green fluorescent material comprising zinc silicate and being arranged within the green subpixels;

a positive surface potential material arranged between the partition walls and the transparent upper substrate; and a discharge gas arranged within the subpixels, wherein the positive surface potential material is arranged in grooves in an upper surface of the partition walls.

20. The PDP of claim 15, the positive surface potential material being arranged in stripes on tops of ones of the partition walls extending in a direction perpendicular to the address electrodes.

* * * * *